US005193669A

United States Patent [19]

Demeo et al.

[11] Patent Number: 5,193,669

[45] Date of Patent: Mar. 16, 1993

[54] SWITCH ASSEMBLY

[75] Inventors: Gregory B. Demeo, Lydeborough, N.H.; Henry E. Molvar, Chelmsford, Mass.; David R. Bergerson, Francestown, N.H.

[73] Assignee: Lucas Industries, Inc., Reston, Va.

[21] Appl. No.: 661,375

[22] Filed: Feb. 28, 1991

[30] Foreign Application Priority Data

Feb. 28, 1990 [GB] United Kingdom ..... 9004532.9

[51] Int. Cl.[5] ..... H01H 1/10

[52] U.S. Cl. ..... 200/512; 200/5 A; 200/302.2; 219/209

[58] Field of Search ..... 200/512, 513, 516, 517, 200/302.2, 5 A; 219/209, 210

[56] References Cited

U.S. PATENT DOCUMENTS

| | | | |
|---|---|---|---|
| 3,382,338 | 5/1968 | Arseneault et al. | 200/517 |
| 3,551,616 | 12/1970 | Juliusburger et al. | 200/46 |
| 3,617,660 | 11/1971 | Krakinowski | 200/1 R |
| 3,676,615 | 7/1972 | Wiedmer | 200/1 R |
| 3,725,907 | 4/1973 | Boulanger | 340/365 |
| 3,806,673 | 4/1974 | Boulanger | 200/516 X |
| 3,879,586 | 4/1975 | DuRocher et al. | 200/5 A |
| 3,999,025 | 12/1976 | Sims, Jr. | 200/516 |
| 4,056,701 | 11/1977 | Weber | 200/314 |
| 4,066,850 | 7/1978 | Heys, Jr. | 200/5 A |
| 4,304,973 | 12/1981 | Fenelle et al. | 200/339 |
| 4,450,324 | 5/1984 | Fukukura et al. | 200/512 X |
| 4,476,355 | 10/1984 | Mital | 200/516 X |
| 4,555,600 | 11/1985 | Morse | 179/134 |
| 4,559,427 | 12/1985 | Dolson et al. | 200/512 |
| 4,584,461 | 4/1986 | Teshima et al. | 219/210 X |
| 4,644,326 | 2/1987 | Villalobos et al. | 340/365 |
| 4,665,291 | 5/1987 | Ishikawa | 200/308 |
| 4,703,139 | 10/1987 | Dunlap | 200/516 |
| 4,724,304 | 2/1988 | Teshima et al. | 219/210 X |
| 4,952,761 | 8/1990 | Viebrantz | 200/513 |
| 4,977,298 | 12/1990 | Fujiyama | 200/517 X |

FOREIGN PATENT DOCUMENTS

A3228242 of 1984 Fed. Rep. of Germany .

OTHER PUBLICATIONS

Elektrotechnik Und Maschinenbau, vol. 100, No. 7, Jul. 1983, Wien, p. 309, Honeywell Austria GmbH.

F&M Feinwerktechnik & Messtechnik, vol. 97, No. 4, Apr. 1989, Munchen, pp. 129-130, O. Limberger.

Elektrotechnik Und Maschinenbau, vol. 100, No. 7, Jul. 1983, Wien, p. 309.

*Primary Examiner*—Henry J. Recla
*Assistant Examiner*—Glenn T. Barrett
*Attorney, Agent, or Firm*—Nixon & Vanderhye

[57] ABSTRACT

A switch assembly comprising a housing, a rigid operating member mounted for movement relative to the housing and accessible to an operator, an electrical contact operable by movement of the operating member from a rest position to an operative position relative to the housing, a flexible seal between the operating member and the electrical contact and capable of transmitting operative movement of the operating member to the contact while preventing passage of moisture and other contaminants from the region of the operating member to the contact, and, a limit preventing movement of the operating member relative to the contact beyond the position at which the contact is operated. The switch can include further operating members and associated contacts and limits carried by the housing and if desired the assembly can incorporate a heater for heating the operating member region of the assembly.

6 Claims, 7 Drawing Sheets

Figure 1:
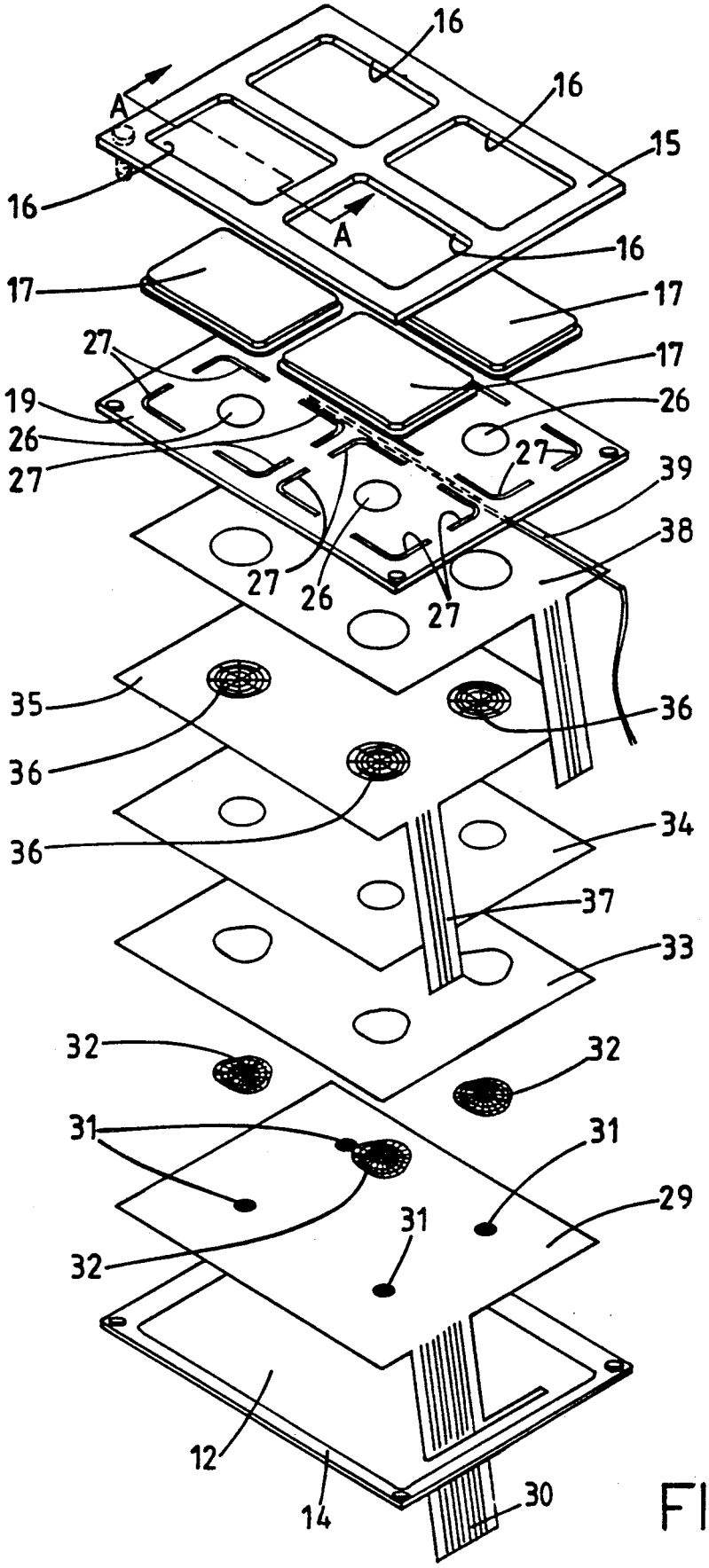

FIG. 4.
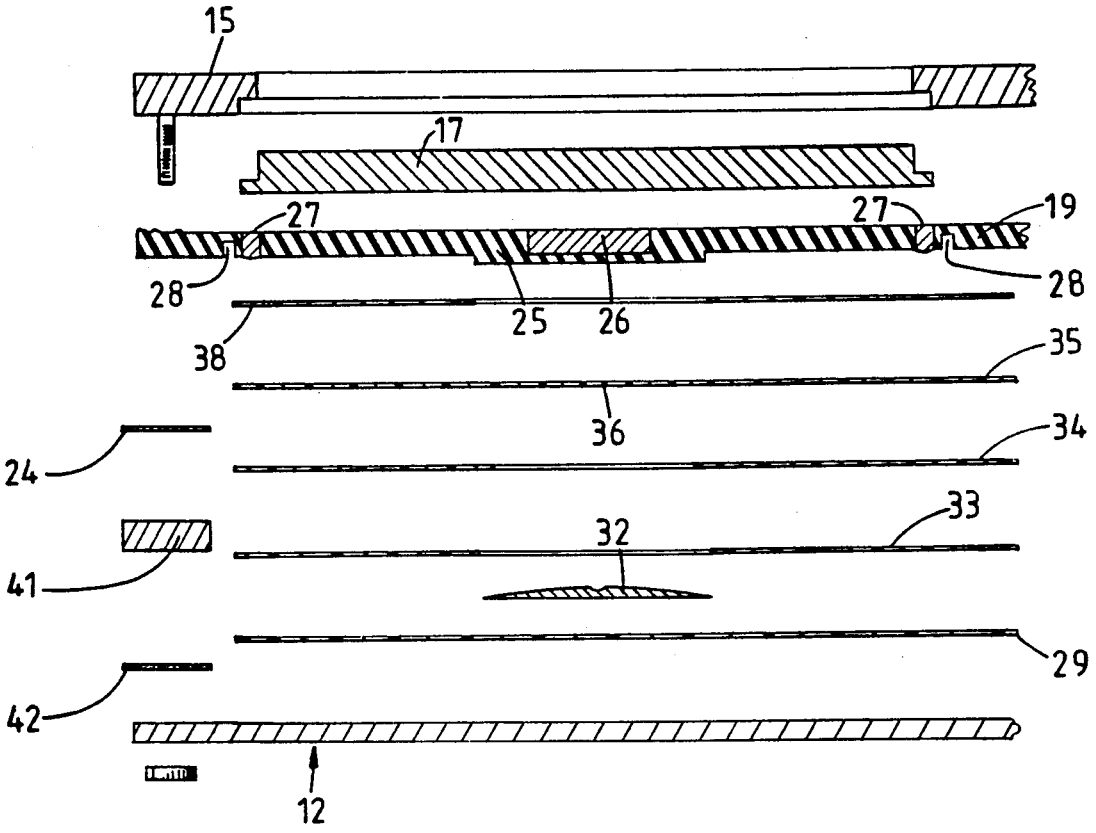
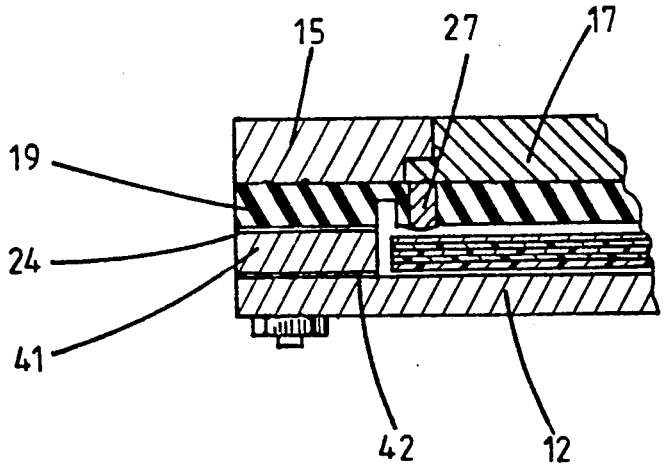
FIG. 5.

FIG.6.
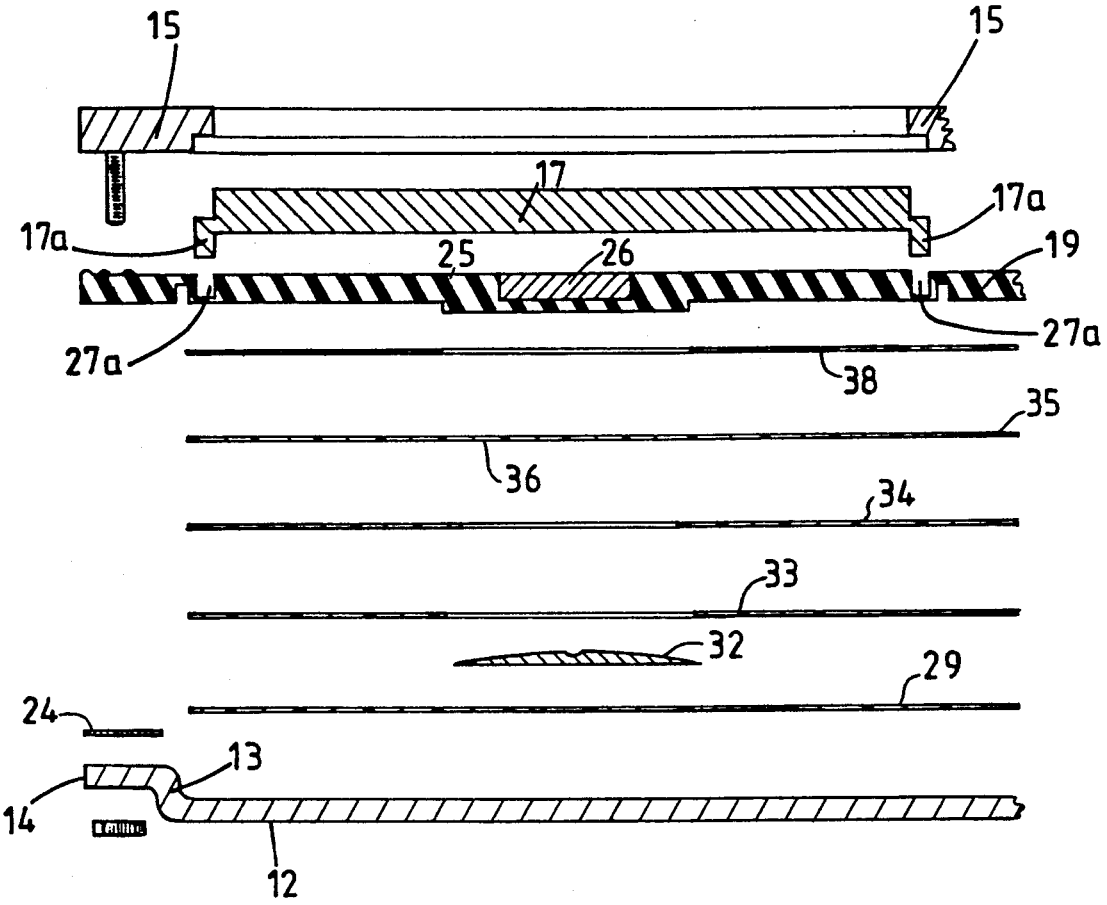
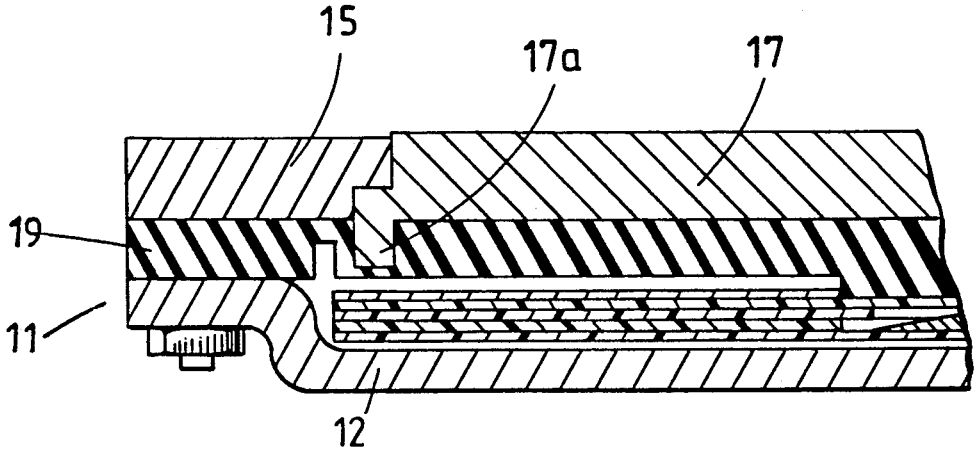
FIG.7.

FIG.8.
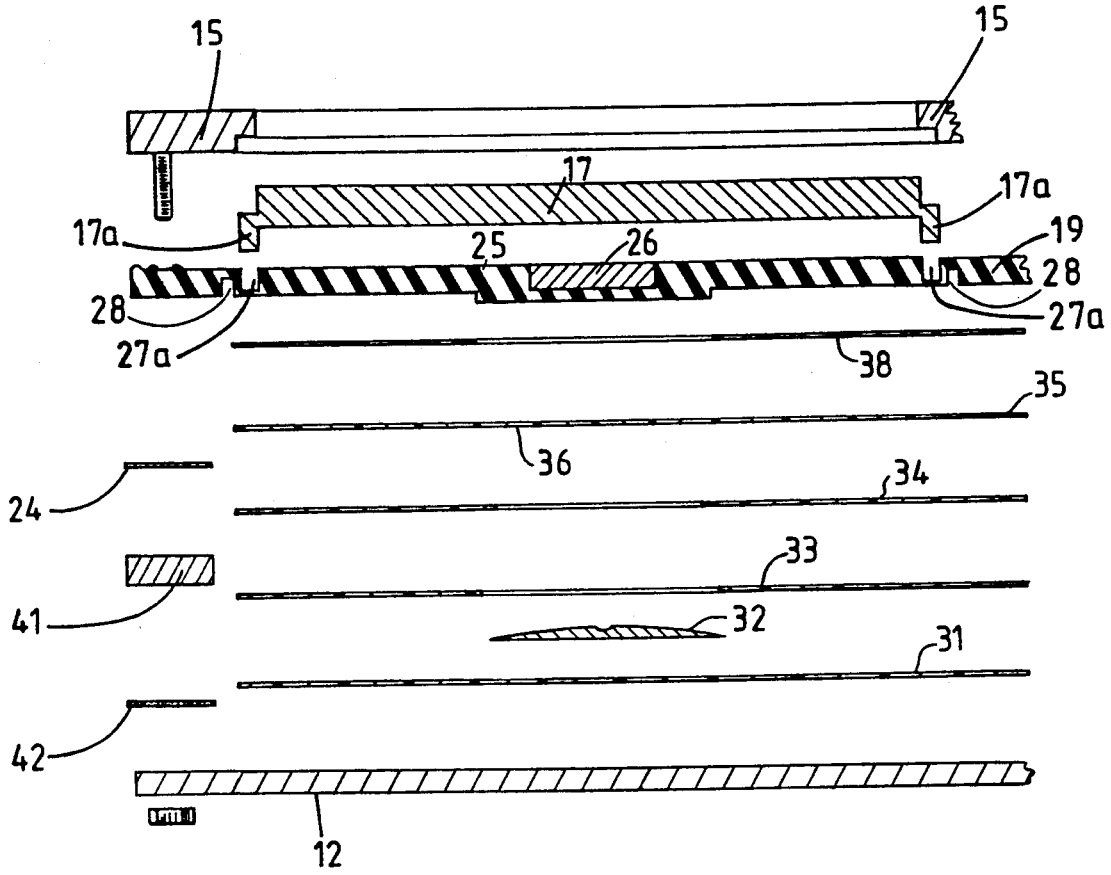
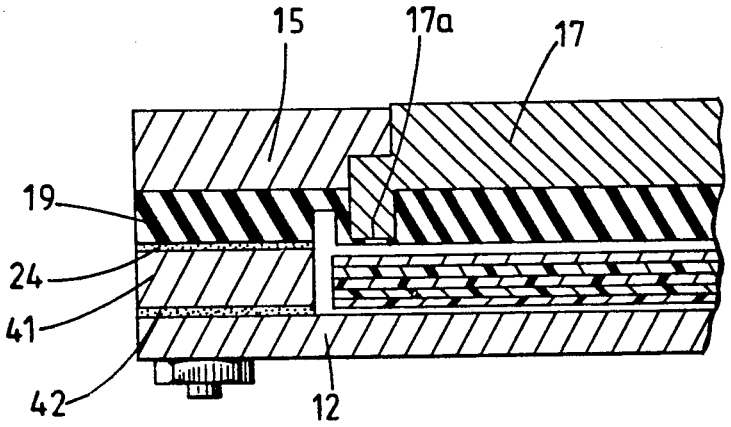
FIG.9.

SWITCH ASSEMBLY

BACKGROUND OF THE INVENTION

1. Field of the Invention

This invention relates to switch assemblies of the kind which are intended to be both robust and weather resistant.

2. Discussion of Prior Art

There is a need for robust and weather resistant switch assemblies in many applications, but a notable application is the "key-pad" of exterior Automatic Teller Machines at banks and similar financial institutions.

Numerous "keyboard" type switch assemblies are known but few address the joint requirements of being "environmentproof" and sufficiently robust to resist, for example, vandalism. U.S. Pat. No. 3,617,660 discloses a switch assembly where attention has been given to moisture protection and to the problems of actuator overtravel. However the solution to the actuator overtravel problem proposed in U.S. Pat. No. 3,617,660 is to transmit actuation movement to the electrical contacts by way of resiliently deformable components which deform to accommodate overtravel of the actuator beyond the position at which the contacts close. Such an arrangement produces a switch "feel" which is spongy and imprecise and moreover while it can accommodate simple overtravel of the actuator it appears unable to accommodate the kind of overloading which can occur in a vandal attack. It is an object of the present invention to provide a switch assembly with improved resistance to attack, both environmental and human.

SUMMARY OF THE INVENTION

In accordance with a first aspect of the present invention there is provided a switch assembly comprising a housing, a rigid operating member mounted for movement relative to the housing and accessible to an operator, electrical contact means operable by movement of the operating member from a rest position to an operative position relative to the housing, flexible seal means between the operating member and the electrical contact means and capable of transmitting operative movement of the operating member to said contact means while preventing passage of moisture and other contaminants from the region of the operating member to the contact means, and, limit means preventing movement of the operating member relative to the contact means beyond the position at which the contact means is operated.

A further object is to provide a switch assembly which can accommodate freezing temperatures and in accordance with a further aspect there is provided a switch assembly comprising a housing, an operating member mounting for movement relative to the housing and accessible to an operator, electrical contact means operable by movement of the operating member from a rest position to an operative position relative to the housing, flexible seal means between the operating member and the electrical contact means and capable of transmitting operative movement of the operating member to said contact means while preventing passage of moisture and other contaminants from the region of the operating member to the contact means, and, heater means for heating the operating member region of the switch assembly.

Preferably in either aspect above the switch assembly includes an operating member return element in the form of a resilient, collapsible dome, said element additionally providing the desired switch "operating feel".

Preferably said dome is electrically conductive, and forms part of the electrical connection of the contact means of the switch assembly.

BRIEF DISCUSSION OF THE DRAWINGS

Figure 2:
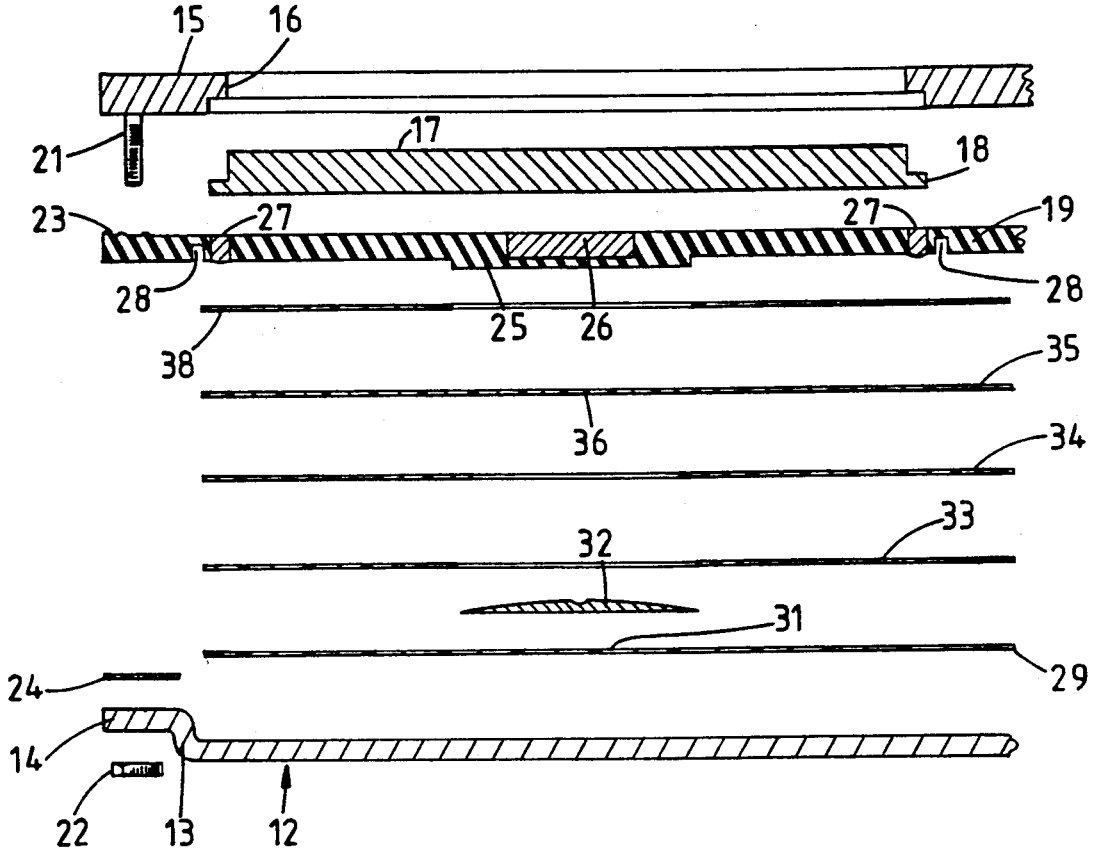
Figure 3:
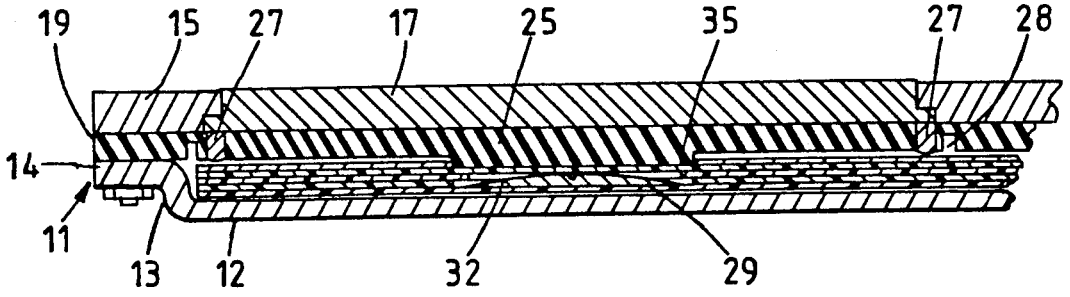
Figure 10:
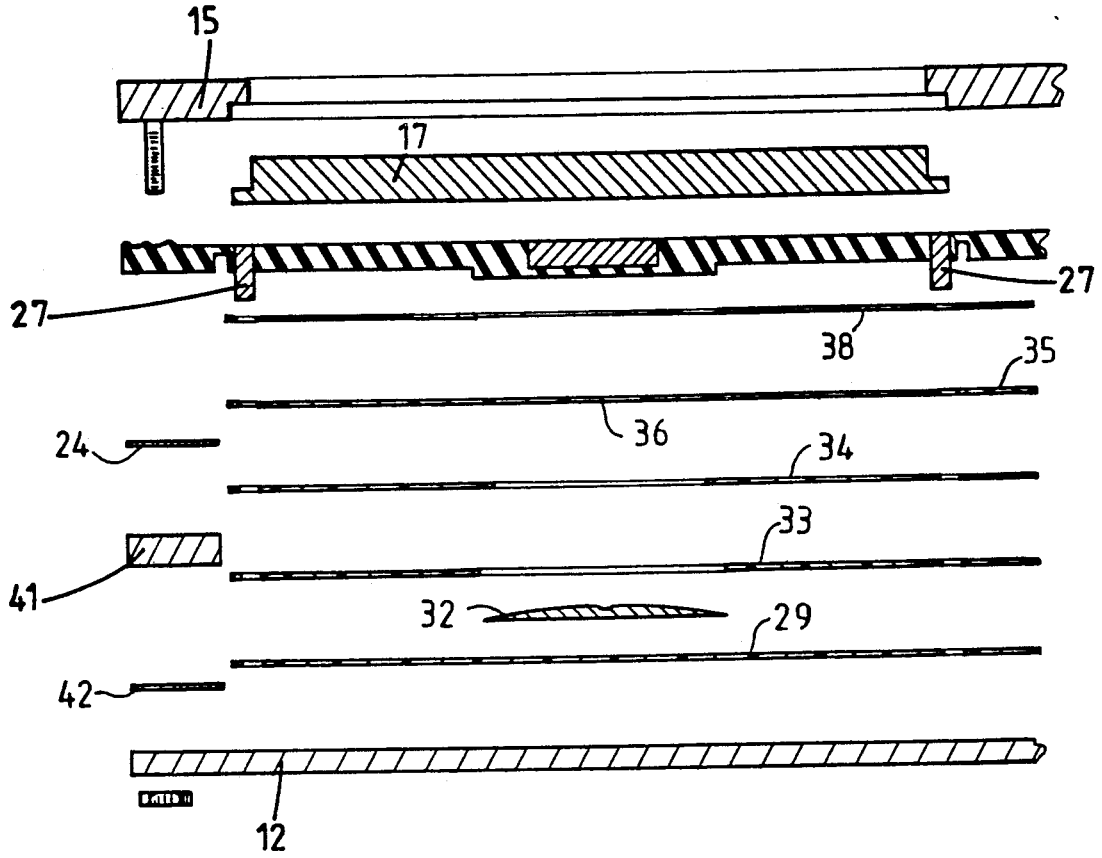
Figure 11:
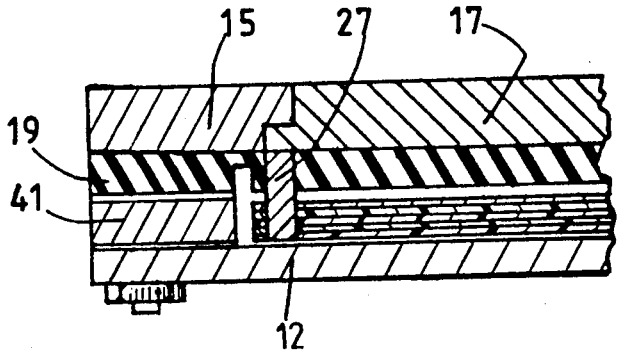
Figure 12:
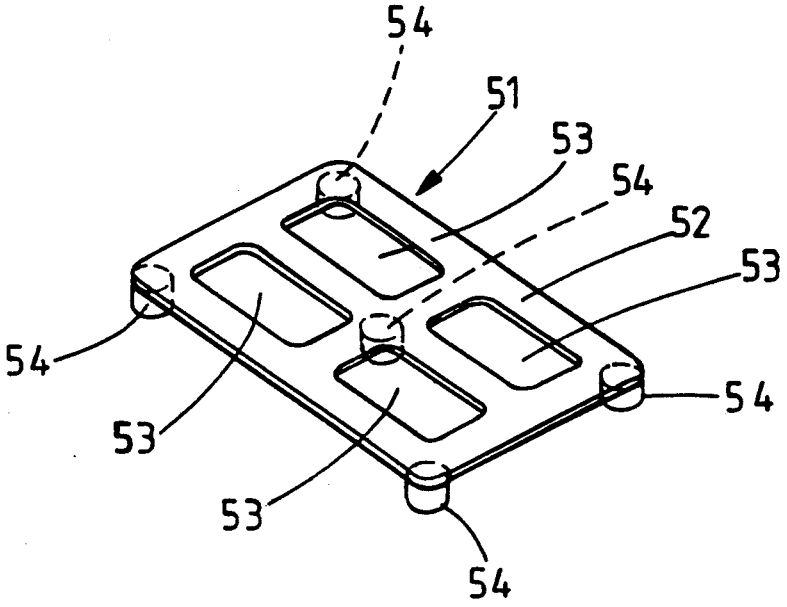
Figure 13:
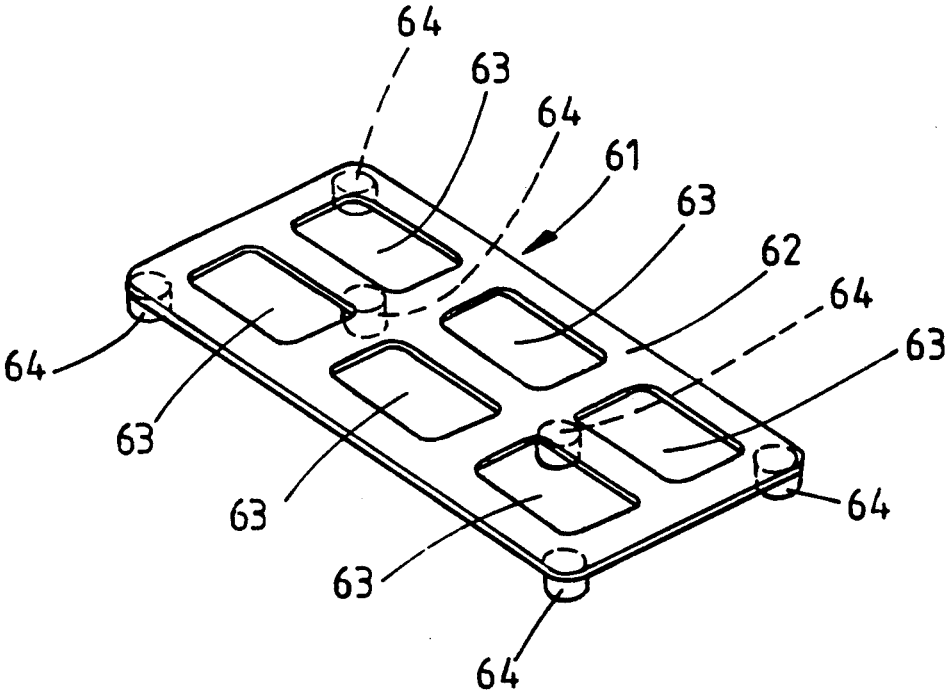

One example of the present invention is illustrated in the accompanying drawings wherein:

FIG. 1 is a diagrammatic, exploded, perspective view of a four-button, automatic teller machine, key-pad, FIG. 2 is an exploded sectional view on the line A—A of FIG. 1, FIG. 3 is a view similar to FIG. 2 but illustrating the components in their assembled configuration, FIGS. 4 and 5, 6 and 7, 8 and 9, and 10 and 11, are views similar to FIGS. 2 and 3 respectively of first, second, third, and fourth modifications of the assembly illustrated in FIGS. 1, 2 and 3, and FIG. 12 is a perspective view of an alternative insert assembly, and FIG. 13 is a view similar to FIG. 12 of a modification thereof.

DETAILED DISCUSSION OF PREFERRED EMBODIMENTS

Referring first the FIGS. 1, 2 and 3 of the accompanying drawings the switch assembly includes a rigid metal housing 11 comprising a rigid, steel, backing plate 12 which is of rectangular shape having an integral, upstanding, peripheral wall 13 the free edge of which is turned outwardly to define a peripheral flange 14 laying parallel to and spaced from the plane of the remainder of the plate 12. The housing 11 further includes a top plate 15 conveniently of stainless steel, the top plate 15 having four rectangular apertures 16 therein, each of which slidably receives a respective rigid operating button or key 17. The operating keys 17 are also conveniently formed from stainless steel, and are of a thickness slightly greater than the thickness of the top plate 15. Each key 17 includes an outwardly extending peripheral flange 18 off-set from the median plane of the key 17, and surrounding each aperture 16 the lowermost face of the top plate 15 is relieved to accept the flange 18. Each key 17 is a relatively close, sliding fit within its aperture 16 and the cooperation of the flange 18 of each key 17 with the relieved region of the plate 15 permits each key 17 to occupy a position relative to the plate 15 such that the undersurface of each key is flush with the undersurface of the plate 15 while preventing further outward movement of a key relative to the plate 15. When the undersurface of each key 17 is flush with the undersurface of the plate 15 the outer surface of each key 17 is raised slightly above the outer surface of the plate 15, the plate 15 being formed with a "brushed" or other decorative but durable surface so that the plate 15 defines a decorative bezel surrounding each of the four keys 17.

The rectangular dimensions of the plate 15 are equal to those of the plate 12 so that the periphery of the plate 15 overlies the flange 14 of the plate 12. Positioned immediately beneath the assembly of plate 15 and keys 17 is a rectangular diaphragm 19 formed from rubber, or other resilient and impervious material, for example low temperature resistant silicone rubber, polyurethane, or ethylene propylene diene. The periphery of the diaphragm 19 is trapped between the periphery of the top plate 15 and the flange 14 and a plurality of screw threaded studs 21 secured to the periphery of the plate 15 and extending perpendicularly from the undersurface thereof, extend through apertures in the periphery of the diaphragm 19 and the flange 14 and, beneath the flange 14 receive screw threaded nuts 22 whereby the plate 15 is clamped to the plate 12 trapping the diaphragm therebetween. In order to ensure good sealing at the periphery of the switch assembly the diaphragm 19 is moulded with peripheral ribs 23 on its upper surface which sealingly engage the undersurface of the plate 15, and a water impervious adhesive or other sealant layer 24 is provided between the lower surface of the diaphragm 19 and the upper surface of the flange 14, it being understood that similar ribs to the ribs 23 could be provided on the underside of the diaphragm in place of the layer 24.

The diaphragm 19 is generally planar and of constant thickness, but at the centre of a rectangular region underlying each of the keys 17 the diaphragm has a thickened region defining a downwardly extending circular plateau 25. Disposed centrally within each of the four plateaux 25, and embedded in the upper face of the diaphragm 19 is a stainless steel or brass insert 26 in the form of a circular disc. It is to be understood that if desired the disc 26 could be integral with the respective key 17 so as to project downwardly therefrom into a recess in the diaphragm 19. However, in the examples illustrated in the accompanying drawings each of the four inserts 26 is separate from its respective key 17 and is secured in place within the diaphragm 19 either by an adhesive, or by vulcanising the rubber of the diaphragm 19 with the insert in position.

At positions corresponding to the corner regions of each of the four keys 17 the diaphragm 19 carries respective L-shaped brass, or stainless steel inserts 27 which extend completely through the thickness of the diaphragm 19. The L-shaped inserts 27 are arranged to lie beneath the four corners of each of the four keys 17 and, as with the insert 26, the inserts 27 can be secured in position by an adhesive, but are preferably secured in position by vulcanising the rubber of the diaphragm 19 around the inserts thereby ensuring an efficient seal between the material of the diaphragm and the material of the inserts. Outwardly from each of the inserts 27 the lower face of the diaphragm 19 is formed with grooves 28 which reduce the thickness of the diaphragm and thus provide locally weakened regions in the diaphragm at which flexure of the diaphragm can readily occur.

Disposed on the base plate 12, within the recess defined by the wall 13 thereof is an electrical contact assembly comprising a rectangular printed circuit member 29 having four exposed conductive contact regions 31 on its uppermost surface. The four contact regions 31 are aligned with the keys 17 respectively and each is connected to a track of a flexible printed circuit member 30 extending from the substrate of the printed circuit member 29 and passing through a slot in the base plate 12. The printed circuit member 29 is rectangular, and thus is positioned within the switch assembly by the wall 13 of the base plate 12.

Seated on the upwardly presented surface of the printed circuit member 29, and overlying each of the exposed contact regions 31, is a respective metal dome 32. The four metal domes 32 are each positioned with their dished face presented to the printed circuit member 29 and their periphery engaging the printed circuit member 29 around, but not in contact with, each of the contacts 31. The domes 32 are resilient, and can be collapsed by the application of pressure to their highest points to cause their highest, central regions to touch the contacts 31. However, in their natural, rest positions, their is no engagement of any part of a dome 32 with its respective contact 31. The domes 32 are held in position relative to the printed circuit member 29 by a dome spacer sheet 33 and a dome retainer sheet 34. The sheets 33 and 34 are both formed from electrically insulating synthetic resin material, and both are of rectangular form corresponding to the rectangular form of the recess defined in the base plate 12 by the wall 13. Thus each of the sheets 33, 34 is located within the switch assembly by the wall 13, and each is preformed with four apertures within which the domes 32 respectively extend. Overlying the sheet 34 is a flexible printed circuit element 35 which is also of rectangular form, and thus is located within the switch assembly by the wall 13 of the base. The downwardly presented face of the element 35 has four exposed, flexible, conductive contact areas 36 presented to the highest points of respective domes 32 protruding above the dome retainer sheet 34. Each of the contact areas 36 is electrically connected to a respective conductive track of an extension 37 of the flexible printed circuit element 35, the extension 37 passing through the aforementioned slot in the base plate 12.

If desired a flexible heater 38 in the form of a laminate of copper and a polyamide or alternatively in the form of a printed circuit sheet can be interposed between the upper surface of the flexible printed circuit element 35 and the undersurface of the diaphragm 19. The heater 38 is illustrated in the accompanying drawings, and it can be seen that again it has a rectangular periphery and thus is located by the wall 13 of the base plate 12, and has four circular apertures through which the plateaux 25 extend respectively.

In the assembled condition of the switch, as illustrated in FIG. 3, the printed circuit member 29 seats against the upper surface of the base plate 12, the domes 32 seat against the member 29, and the highest, centre points of the domes 32 engage, or are close to, the centres of the conductive areas 36 of the printed circuit element 35. The lower surfaces of the plateaux 25 engage the upper surface of the element 35 in alignment with the contact areas 36 thereof, and the upper surface of the diaphragm 19 engages the undersurfaces of the keys 17 which are in their outermost, rest positions in which their top surfaces project slightly above the top surface of the top plate 15, this being the rest condition of each of the switch assemblies. It is important to recognise that in the rest position of each of the switch assemblies there is a clearance between the lower face of the elements 27 and the upper face of the heater 38 to permit depression of the respective key 17 towards the base plate 12.

In operation, when a key 17 is depressed by an operator it is displaced from the plane of the plate 15 towards the plane of the plate 12 against the resilience of the diaphragm 19 and the resilience of the respective dome 32. The diaphragm 19 flexes in the region of the grooves 28 associated with the key 17 being operated, and the dome 32 collapses under the loading applied thereto by the key 17 through the intermediary of the insert 26, the thin region of the plateau 25 beneath the insert 26 and the printed circuit element 35. It will be recognised that the dome 32 is in contact with the respective conductive area 36 of the flexible printed circuit 35, and thus is electrically connected thereto. Thus as the dome collapses a point is reached at which the central region of the dome moves into engagement with the respective exposed contact area 31 of the printed circuit member 29 thereby establishing an electrical connection between the contact areas 31 and 36 and so making the electrical circuit through the switch assembly. Upon release of the key 17 the combined resilience of the dome 32 and the diaphragm 19 will return the parts, including the key 17, to their rest positions so breaking the circuit.

It will be understood that contact arrangements utilizing resilient "overcentre" domes such as domes 32 are susceptible to damage resulting from overtravel of the actuator beyond the intended range of flexure of the dome. In the present switch construction the elements 27 are not compressible, and thus the clearance between the elements 27 and the top surface of the heater 38 determines the maximum throw of the key 17 during operation. Once this clearance has been taken up any load applied to the key 17 is transmitted through the elements 27 and the peripheries of the heater 38, the printed circuit 35, the sheets 34 and 33, and the printed circuit member 29, to the base plate 12 thus providing a positive stop to the movement of the rigid key 17 so that the risk of damage to the flexible printed circuit 35 and the dome 32, through excessive movement thereof, is avoided.

It will be recognised that if desired the appropriate clearance could be introduced, by appropriate positioning of the inserts 27, between the inserts 27 and the key 17 in the rest position of the switch assembly.

It will be recognised that the resilient collapse of each dome 32 provides a particular operating feel of the respective switch assembly, and thus the nature of the dome will be chosen such that its collapse characteristics provide the desired tactile characteristics of the switch assembly.

It will be recognised that moisture entering the switch assembly between the plate 15 and the keys 17 cannot penetrate the electrical contact area of the switch assemblies, these being sealed by the diaphragm 19. Moreover, where there is likelihood of freezing of moisture in the region of the keys 17 then the heater 38 will be incorporated in the switch assembly and desirably, but not essentially, a temperature sensor 39, for example a thermocouple or a resistance/temperature detector, will also be incorporated so as to provide the possibility of automatic energisation of the heater 38. Electrical connections for the sensor 39 and the heater 38 are routed from the switch assembly through the aforementioned slot in the base plate 12 and in some cases it may be possible for the sensor 39 to be integrated with the heater 38. It will be understood however that there will be environments where the heater 38 and the temperature sensor 39 are not needed, and thus they can be omitted. The thickness of the heater 38 is minimal, and in many applications it may not be necessary to use inserts 27 of increased thickness. Where the increased clearance by virtue of omission of a heater 38 is of importance then rather than providing a different diaphragm assembly, with thicker inserts 27, it may be preferable to introduce a spacer sheet of the same thickness and configuration as the heater 38 to preserve the predetermined positive stop in movement of the keys 17.

The switch assembly illustrated in FIGS. 4 and 5 differs from that illustrated in FIGS. 2 and 3 in that a planar base plate 12 is utilized, and an annular, rectangular spacer 41 fulfils the function of the integral wall 13 and flange 14 of the base plate 12 of FIGS. 1, 2 and 3. A water impervious adhesive layer 42, or a layer of other sealant, is provided between the lower face of the spacer 41 and the upper surface of the planar plate 12 to ensure that the housing 11 is sealed. There is no change in the remaining components of the switch assembly, and the alternatives discussed above in relation to FIGS. 1, 2 and 3 apply equally to the arrangements illustrated in FIGS. 4 and 5, 6 and 7, 8 and 9, and, 10 and 11.

The arrangement illustrated in FIGS. 6 and 7 differs from the arrangement illustrated in FIGS. 1, 2 and 3 in that the inserts 27 are defined by integral formations 17*a* at the periphery of the respective key 17 and are received within respective channels 27*a* in the upper face of the diaphragm 19. The arrangement illustrated in FIGS. 8 and 9 combines the modifications illustrated in FIGS. 4 and 5, and, 6 and 7 respectively in that the inserts 27 of FIGS. 1, 2 and 3 are defined by integral formations at the pheriphery of the respective key 17 and the base plate 12 is planar, the function of the wall 13 and flange 14 having being performed by the spacer 41. The very thin web of material of the diaphragm 19 beneath the lower faces of the inserts 27 maintains the integrity of sealing of the contact regions of the switch assembly but at the same time has negligable effect on the positive stop action provided by the inserts in relation to key "overtravel".

In the assembly illustrated in FIGS. 10 and 11 the inserts 27 are extended beneath the diaphragm 19 and passed through corresponding apertures in the heater 38 the flexible printed circuit element 35, the sheets 34 and 33, and the printed circuit member 29 to be engagable directly with the upper surface of the base plate 12. In this way any "overload" applied to the key 17 is transmitted directly to the base plate 12 through the inserts 27 without the risk of damaging the components 29, 33, 34, 35, and 38. Thus an even more positive load limiting effect is achieved since there is no possibility of excessive forces being permitted to be applied to the flexible printed circuit element 35 and the dome 32 by virtue of compression of the components 29, 33, 34, 35 and 38 between the elements 27 and the base 12. It is to be recognised that variants of the assembly illustrated in FIGS. 10 and 11 can be produced in which the base plate has an integral wall 13 and flange 14 and the spacer 41 is omitted, and variants in which the elements 27 are integral formations of the keys 17 respectively.

Overloading of a dome 32 could cause total failure of the dome, thus potentially leaving the switch permanently in a closed condition, or could result in the dome taking a permanent set, and thus the switch having a different operating feel. Other dangers of overload, or overtravel of the keys 17 include the rupture of the diaphragm 19 and/or rupture of the flexible printed circuit element 36. These possibilities are of course eliminated by the use of inserts or the like limiting the travel of the keys 17 towards the base 12. It is to be understood that the provision of a heater such as the heater 38, with or without a temperature sensor 39, may be desirable in switch assembly to be used in harsh environments, other than those having means limiting the travel of the operating key.

The insert arrangements described above make use of L-shaped metal inserts for limiting movement of the keys 17 in the operative direction. The inserts 17 are conveniently secured in place within the diaphragm 19 by being vulcanised into the material of the diaphragm, but FIG. 12 illustrates an alternative insert arrangement which, for many applications, will be preferable by virtue of simplifying the manufacturing processes. FIG. 12 illustrates an insert assembly 51 for use with a single key 17, it being recognised that there will be a similar insert assembly 51 associated with each of the other keys 17. The insert assembly 51 is moulded in a substantially rigid synthetic resin material, conveniently a glass-reinforced polyester resin which has a high heat deflection temperature. The moulding resin known as "DUPONT RYNITE " is a suitable material, and the version of "RYNITE" known as "415HP" has been found to be particularly effective. Each insert assembly 51 comprises a planar rectangular element 52 formed with four parallel and regularly spaced rectangular apertures 53. Integral with the element 52 and projecting downwardly from one face thereof are five substantially identical cylindrical projections 54 there being a projection adjacent each corner of the element 52 and a centrally disposed projection.

Relating the assembly 51 to the embodiment illustrated in, for example, FIG. 1 then four assemblies 51 are associated with the diaphragm 19 and are utilised in place of the metal inserts 26 and 27. The diaphragm 19 is moulded with the four appropriately positioned assemblies 51 in situ in the mould, the technique for forming the diaphragm thus being an insert moulding technique wherein the material forming the diaphragm flows around the assemblies 51 to form a composite diaphragm /insert unit. The diaphragm is thus still continuous so as to be able to perform its sealing function in the switch, and the assemblies 51 fulfil the function of the inserts 27 in limiting movement of their respective key 17, and the function of the respective insert 26 in transmitting operative movement of the respective key to the associated electrical contact assembly of the switch. A version of the element 51 without the apertures 53 has been utilised, but it is believed that the assembly 51 illustrated in FIG. 12 currently represents the best mode of providing the movement transmitting, and movement limiting inserts associated with the diaphragm 19.

FIG. 13 shows a modification 61 of the insert assembly 51 of FIG. 12 the assembly 61 being intended for use with operating key 17 which are of greater length than the keys 17 with which the assembly 51 is to be associated. The larger assembly 61 is thus longer than the assembly 51 but still includes the planar element 62 having a plurality of regularly spaced apertures 63 therein. The element 62 has six, rather than five integral cylindrical projections 64 again there being a projection at each corner of the element 62, and in this instance two projections 64 spaced along the longitudinal centre line over the element 62. The two projections 64 spaced along the centre line of the assembly 61 are associated with respective contact arrangements of the switch, the two contact arrangements being preferably electrically connected in parallel so that during operation of the elongate key 17 associated with the assembly 61 then the appropriate electrical function will be effected by closure of the contacts associated with one or the other or both of the projection 64. As with the insert assembles 51, it is preferred to mould the appropriate number of insert assemblies 61 into the diaphragm 19.

In each of the switch embodiments disclosed above it is to be recognised that it may be appropriate, in certain applications, to replace the rigid, steel, backing plate 12 with a mechanically equivalent, but cheaper backing plate formed as a rigid synthetic resin moulding. A suitable material for moulding a rigid backing plate is a polyethylene sulfide (PPS) and the material "RYTONR-7" available from "Phillips Petroleum Co" has been found to be particularly suitable.

It will be recognised that switch assemblies as described above can be utilized alone or in groups other than the group of four illustrated. Moreover such assembles are not restricted to use in A.T.Ms.

We claim:

1. A switch assembly comprising:

a housing having a base plate;

a rigid operating member at least partially within said housing;

means for mounting said operating member for movement relative to the housing with said operating member being accessible to an operator, electrical contact means, at least partially within said housing and being responsive to movement of the operating member relative to the housing, for changing from a non-conducting rest position to a conducting operative position, flexible seal means positioned at least partially within said housing and being located between the operating member and the electrical contact means and capable of transmitting operative movement of the operating member to said contact means while preventing passage of moisture and other contaminants from the region of the operating member to the contact means, and, limit means for preventing movement of the operating member relative to the contact means beyond said conducting operative position wherein said limit means comprises rigid spacer elements disposed between a peripheral region of the operating member and the base plate wherein said rigid spacer elements are bonded to said seal means.

2. An assembly as claimed in claim 1 wherein said spacer elements extend through said seal means.

3. A switch assembly comprising:

a housing, a rigid operating member at least partially within said housing, means for mounting said operating member for movement relative to the housing with said operating member being accessible to an operator, electrical contact means, at least partially within said housing and being responsive to movement of the operating member relative to the housing, for changing from a non-conducting rest position to a conducting operative position, flexible seal means at least partially within said housing and being located between the operating member and the electrical contact means and capable of transmitting operative movement of the operating member to said contact means while preventing passage of moisture and other contaminants from the region of the operating member to the contact means, and, limit means for preventing movement of the operating member relative to the contact means beyond said conducting operative position including electrical heater means for heating the operating member region of the switch assembly wherein said heater means is in the form of a flexible sheet disposed between said seal means and said contact means.

4. An electrical switch assembly comprising a housing having a rigid base plate and a rigid cover plate parallel to and spaced from the base plate, a plurality of operating members disposed in respective apertures in said cover plate, each of said operating members being in the form of a rigid element movable from a rest position in which said operating members are coplanar, towards said base plate to actuate respective contact means, a flexible sealing diaphragm disposed between said operating members and said base plate and trapped at its periphery between peripheral regions of said cover plate and said base plate, respective electrical contact means disposed beneath each operating member for actuation thereby and positioned between said seal means and said base plate, and, rigid spacer elements disposed between the periphery of each operating member and said base plate for limiting movement of each operating member towards the base plate to an amount sufficient to operate the respective contact means, said spacer elements extending through and being sealingly engaged by said sealing diaphragm.

5. An assembly as claimed in claim 4 wherein an electrical heater unit is provided beneath the sealing diaphragm to effect heating of the operating member region of the assembly.

6. An electrical switch assembly comprising a housing having a rigid base plate and a rigid cover plate parallel to and spaced from the base plate, a plurality of operating members disposed in respective apertures in said cover plate, each of said operating members being in the form of a rigid element movable from a rest position in which said operating members are coplanar, towards said base plate to actuate respective contact means, a flexible sealing diaphragm having a periphery disposed between said operating members and said base plate and being trapped at its periphery between peripheral regions of said cover plate and said base plate, respective electrical contact means disposed beneath each operating member for actuation thereby and positioned between said seal means and said base plate, and, rigid spacer means, disposed between a periphery of each operating member and said base plate, for limiting movement of each operating member towards the base plate to an amount sufficient to operate the respective contact means, said spacer means at least partially received within the thickness of said sealing diaphragm.

* * * * *